United States Patent [19]

Salsich, Sr.

[11] 3,964,743

[45] June 22, 1976

[54] BASKETBALL BACKBOARD STRUCTURE

[75] Inventor: Peter W. Salsich, Sr., Webster Grove, Mo.

[73] Assignee: Playground Corporation of America, Long Island City, N.Y.

[22] Filed: June 24, 1975

[21] Appl. No.: 589,766

[52] U.S. Cl. ..... 273/1.5 R
[51] Int. Cl.[2] ..... A63B 63/02
[58] Field of Search ..... 273/1.5

[56] References Cited

UNITED STATES PATENTS 3,233,897 2/1966 Sheets ..... 273/1.5 R 3,788,642 1/1974 Matras et al. ..... 273/1.5 R

*Primary Examiner*—Paul E. Shapiro

[57] ABSTRACT

A basketball backboard of cast material such as aluminum or of structural foam having integral ribs projecting from its rear surface arranged maximally to minimize weight, eliminate dead spots and in a two pole or bracket mounting mode to transmit hoop deflections directly to the mounting means.

10 Claims, 4 Drawing Figures

BASKETBALL BACKBOARD STRUCTURE

BACKGROUND OF THE INVENTION

The present invention relates to improvements in basketball backboard construction. Ideally, a basketball backboard should be reasonably lightweight, durable, preferably weatherproof for outdoor installations. It should present a flat unbroken playing (rebounding) surface so that a basketball will have a true bounce therefrom. Within the impact force range of the basketball with respect to the playing surface, the board should have no "dead spots" i.e. local deflection areas which would affect the consistency of the bounce. Finally, mounting stresses, whether the board is single, multi-pole or bracket mounted and stresses caused by hoop deflections should be so transmitted and distributed by the backboard construction so as to eliminate distortion of the rebounding surface.

Many attempts have heretofore been made to achieve some or all of the above objectives; however, the discovery of how properly to integrate design with commercially feasible materials to achieve each and every one of the above-stated objective ideals has not, until the present invention, been made.

Commensurate with achieving integration of all of the stated objectives, a unitary construction of rigid, durable cast material was chosen, for example, cast aluminum, U.S. Pat. No. 3,788,642 is illustrative of one prior attempt to mold a backboard of cast fiberglass but has several deficiencies. Although integrally cast ribs are included in that design, the placement and number of such ribs does not minimize the use of cast material and does not optimally maximize reinforcement in critical areas susceptible of local deflection; nor does that design ideally distribute other stress forces induced by mounting and hoop deflections. The backboard construction provided by the present invention uniquely solves these and other difficulties.

SUMMARY OF THE INVENTION

The present invention comprises a basketball backboard of cast material, for example of cast aluminum or of structural foam, which is uniquely constructed to obviate general and local flexing of the play/rebound surface which might adversely harm the quality of play and which could weaken the backboard itself. Accordingly, the backboard of the invention has a planar play/rebound surface and projecting from the reverse side a plurality of ribs integrally cast therewith comprising a central horizontal rib and upper and lower ribs parallel thereto. These ribs provide lateral stiffness to the board. Two diagonal integrally cast ribs conjoin at their upper ends to the upper horizontal rib at points equi-distant from the edges of the backboard and extend diagonally downwardly to cross in the central area of the backboard, for example immediately above the hoop, in other words, where impact forces might be greatest. Proceeding downwardly, the diagonal ribs straddle the hoop mounting area and conjoin with opposing edges of perimetrical sections which extend about the edges of the backboard. By this unique method of reinforcement, the rigidity of the lateral or horizontal ribs is transmitted to each other and is greatly reinforced throughout the central area of the board. Furthermore, each of the upper and lower horizontal ribs contain tapped openings for mounting brackets (supplementary to a single pole mounting mode) or for use in a two pole mounting mode. Board mounting stresses are equally transmitted by the above-described horizontal and diagonal rib configuration; also, stresses imposed upon the board by the hoop (particularly in the two pole mounting mode) are transmitted to both poles and not permitted to deflect the board. These and other aspects of the invention will be seen from an examination of the following detailed specification and of the drawing in which:

DESCRIPTION OF PREFERRED EMBODIMENTS

Figure 1:
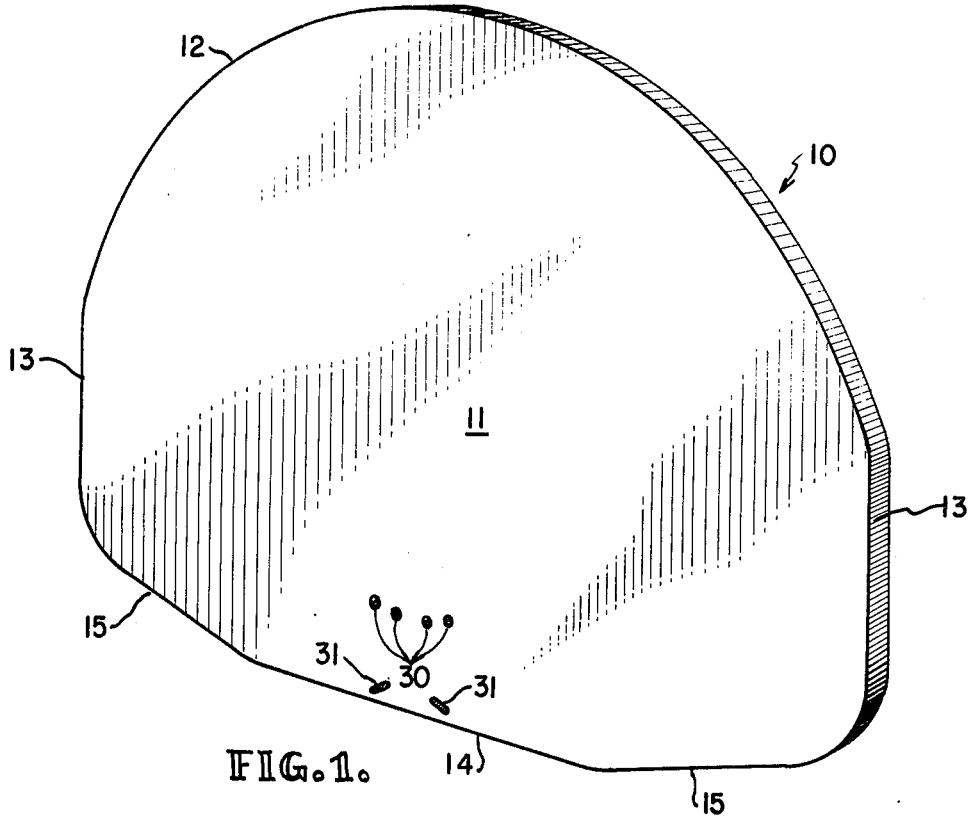
FIG. 1 is a perspective of the backboard of the invention showing the frontal or playing surface.
Figure 2:
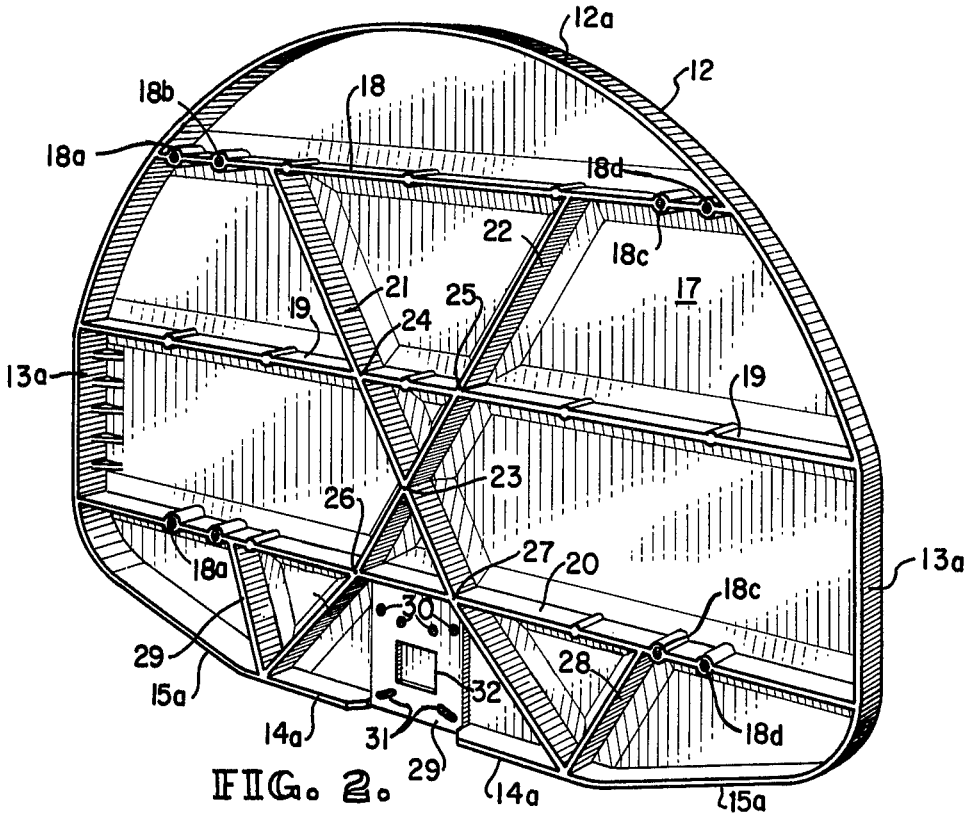
FIG. 2 is a perspective view of the reverse surface of the backboard, including integral reinforcing members projecting therefrom.

Referring now to the drawing and initially to FIGS. 1 and 2 thereof, a backboard 10 constructed in accordance with the principles of the present invention has been illustrated. The backboard 10 is of durable, weatherproof cast material which in a particular embodiment may be aluminum. Another cast material suitable for the disclosed construction is structural foam. The backboard has a frontal surface 11 (play/-rebound area) having the conventional backboard shape, that is, being defined by an arcuate upper perimeter 12, vertical sides 13, a horizontal bottom edge 14 and angular edges 15 connecting bottom edge 14 and sides 13. The surface 11 is cast as a plane, and it is a principal inventive feature of the present invention that the planar play/rebound surface 11 shall be maintained at all times during various stress or impact forces thereon in a rigid manner without local or overall deflection.

Referring now to FIG. 2, the reverse side 17 of the backboard 10 has been illustrated. Integrally cast members 12*a*, 13*a*, 14*a* and 15*a* project rearwardly about the perimeter of the surface 17 from the respective edges 12–15. Thus, the entire perimeter (except for a short break at the center of horizontal member 14*a* ) is rigidly reinforced in cast aluminum. Three generally horizontal ribs 18, 19 and 20 extend laterally between the projecting edge reinforcement members 12*a*–15*a*, the ribs 18–20 also being integrally cast and conjoined with the surface 17. The ribs 18–20 securely rigidize the backboard construction laterally across the board, and it has been found that only three horizontal structures are sufficient in combination with the remaining diagonal rib reinforcing structure which will now be described.

Two reinforcing ribs 21 and 22 extend diagonally downwardly from equi-spaced junctures with the uppermost rib 18. The ribs 21 and 22 interconnect generally along the vertical center of the backboard 10 and further extend downwardly to conjoin with the lower projecting reinforcement 14*a*. At the same time, each of the ribs 21 and 22 conjoin generally centrally of the backboard 10 at 24, 25, 26 and 27 with horizontal ribs 19 and 20. Ribs sections 28, 29 continue diagonally upwardly from sections 14*a* to intercept and join with rib 20 as additional reinforcement of the lower backboard area.

It will be observed that the addition of diagonal ribs 21 and 22 as illustrated uniquely strengthens the central portions of the backboard 10. This is the area which will receive the greatest impact forces during play and is the area in which the prevention of local deflections known as "dead spots" must absolutely be prevented. Furthermore, it will be noted that the rib members 21 and 22 tie together each of the horizontal or lateral ribs 18–20 so that the strength imparted by these members will carry one to the other and finally to the lower projecting edge sections 14*a*. There are other reasons for this unique reinforcing structure, beyond the prevention of "dead spots" which will be explained.

Figure 3:
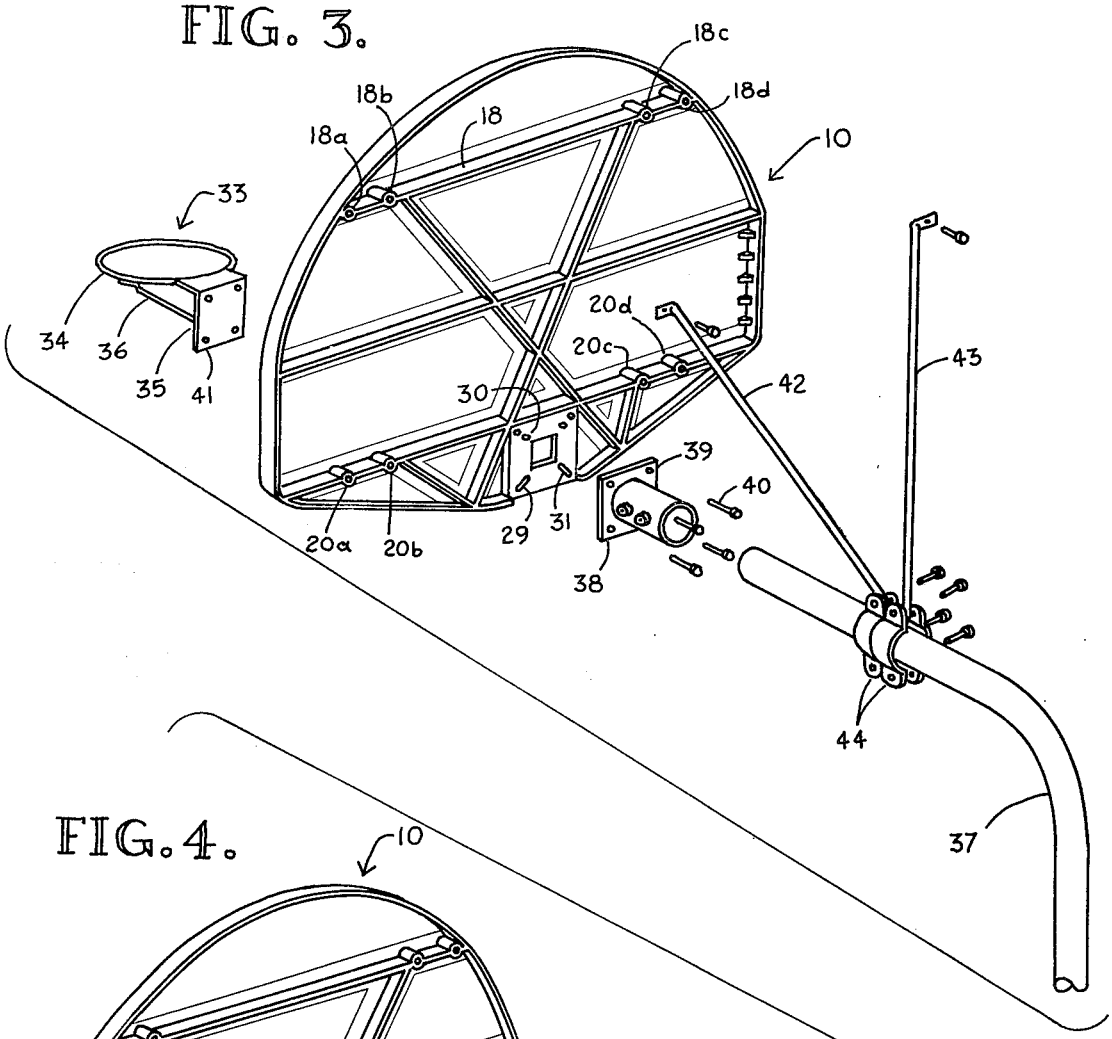
FIG. 3 is an exploded view of the backboard of the invention showing a single front mounting arrangement including frontal mounting of the hoop and bracket assembly.
Figure 4:
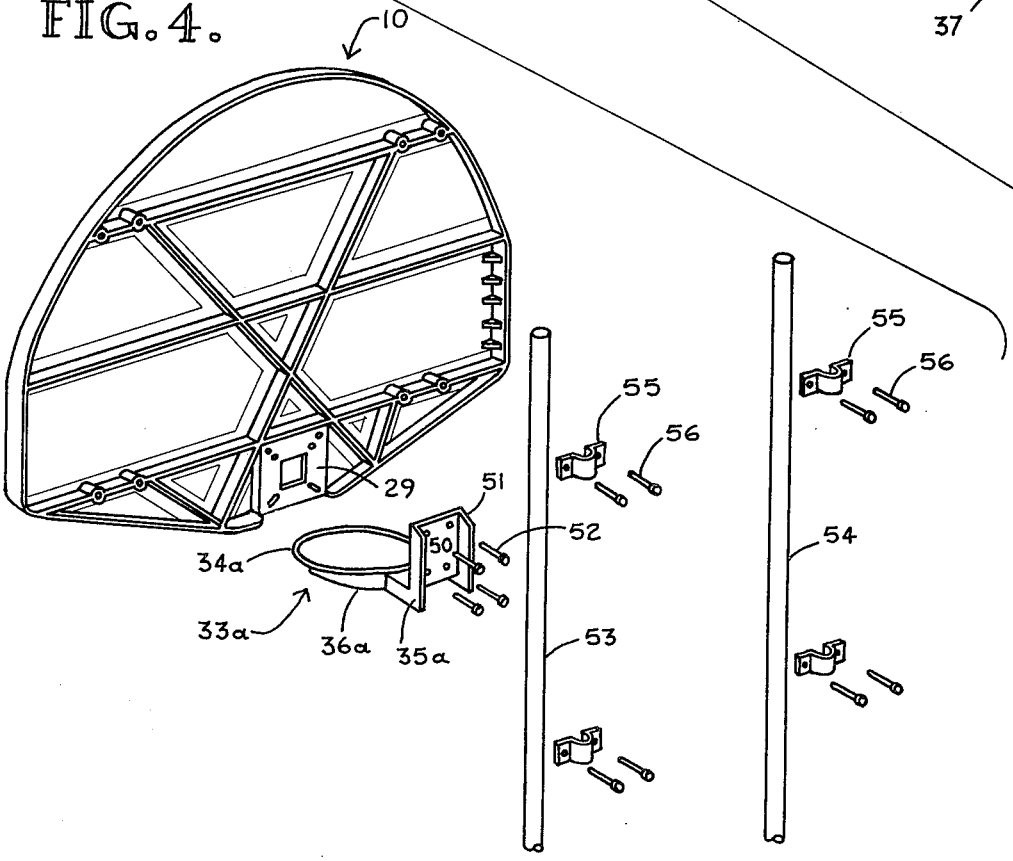
FIG. 4 is an exploded view showing a two pole mounting mold and rearward mounting of the hoop and bracket assembly.

It will be noted that intermediate the section 14*a* there is a plate 29 which defines a series of holes 30 and two elongated slots 31. The plate 29 further includes a rectangular opening 32. As best seen in FIGS. 3 and 4, plate 29 which is integrally cast as a part of the backboard 10 comprises mounting means for hoop and mounting bracket assemblies 33 (FIG. 3) and 33*a* (FIG. 4). In the configuration of FIG. 3, a hoop and bracket assembly 33 is designed to mount upon the forward face of the backboard 10 while in the configuration of FIG. 4 the hoop and bracket assembly is rearwardly mounted. The hoop and bracket assembly 33 and 33*a* each comprise respectively the regulation hoop 34, 34*a*, L-shaped brackets 35, 35*a* and reinforcing arms 36, 36*a*. The purpose of having a plurality of holes 30 and two lower elongated slots 31 is to permit the plate 29 to accommodate various mounting hole configurations of hoop and bracket assemblies which are commercially available.

Referring specifically to FIG. 3, the backboard 10 may be supported in its regulation playing position by a single pole 37 having at the upper horizontal extension thereof a mounting plate 38. Plate bracket 38 includes bolt holes 39 for receiving bolts 4, and it will be understood that bolt holes 39 coincide with holes 30 and slots 31 of the plate 29 and with corresponding bolt holes 41 in the hoop and bracket assembly. Thus, the parts shown in exploded position can be bolted securely together. Additionally, three supplemental reinforcing rods 42 and 43 are secured by split collar brackets 44 to the pole 37. Rib 18 includes tapped bosses 18*a*–18*d*, and the upper ends of rods 42 and 43 are mounted to selected pairs of the rib bosses, for example 18*a* and 18*d*. In order to rigidly connect the upper portion of the backboard 10 to the pole 37, it should be noted that each of the tapped bosses 18*a*–18*d* extend only through the rib 18; that is, the play-rebound surface is not broken by any apertures or bolt heads which would provide distortion.

Referring to FIG. 4, a two pole mounting arrangement provided by the present invention is illustrated. In this configuration, the hoop and bracket assembly mount from the rear upon plate 29 by means of plate bracket 50. Holes 51 therein pick up holes and slots 30, 31 with bolts 52. the perimetrical sections 14*a* are thus separated for the described rearward mounting. Two poles 53, 54 equipped with clamps 55 are secured by bolts 56 to the rib 18 utilizing tapped bosses 18*a*–18*d* and similar vertically oriented bosses 20*a*–20*d* in lower rib 20.

It will be noted that in the single pole mode, all forces upon the hoop are transmitted directly to the pole.

Supplementary backboard support or mounting forces are transmitted through diagonal ribs 21, 22 to the single pole and to the pole by rods 42, 43.

In the two pole mounting mode, forces upon the hoop structure are transmitted by the diagonal ribs 21, 22 to the upper series of rib boss connections 18*a*–18*d* while lower horizontal rib 20 transmits such forces to lower mounting connections 20*a*–20*d*.

Thus, in both single and two pole mounting configurations, all hoop and mounting forces are transmitted uniformly and directly to the pole mount or mounts. At the same time, the unique horizontal and diagonal rib combination of the invention prevents flexing of the play/rebound area when subjected to impact forces from the ball in play.

It will be understood that the foregoing description has been of particular embodiments of the invention and is therefore representative. In order to appreciate the scope of the invention, reference should be made to the appended claims.

I claim:

1. In a basketball backboard of cast material having a planar play/rebound surface on one side and a reverse surface reinforced by a plurality of projecting ribs integrally cast therewith projecting from said reverse surface, the improvement wherein said ribs comprise a central generally horizontal rib and upper and lower ribs parallel thereto and defining together with said central rib generally vertically equal parts of the reverse side of said backboard, two diagonal ribs each conjoined with the upper rib at points equi-distant from edge portions of the backboard, each diagonal rib crossing the other centrally of the backboard and extending thereafter to the lower edge of said backboard, each diagonal rib being conjoined with said central and lower horizontal ribs such that their lateral rigidizing effect is transmitted particularly throughout the central part of the play/rebound surface.

2. The basketball backboard according to claim 1 wherein hoop mounting means are provided at the lower central part of the backboard and the lower ends of said diagonal ribs straddle said hoop mounting means.

3. The backboard according to claim 2 wherein said diagonal ribs cross above said hoop mounting means intermediate said lower and central horizontal ribs.

4. The backboard according to claim 3 wherein said upper horizontal rib includes backboard mounting means immediately adjacent to the conjoined upper ends of said diagonal ribs.

5. The backboard according to claim 4 wherein said backboard mounting means comprises tapped openings extending into said ribs but not through said backboard.

6. The backboard according to claim 4 wherein the lower horizontal rib includes backboard mounting means oriented to permit the attachment of two vertical poles one each to vertically oriented mounting means in said upper and lower ribs.

7. The backboard according to claim 6 wherein said backboard mounting means comprises tapped openings extending into said ribs but not through said backboard.

8. The backboard according to claim 7 wherein said hoop mounting means is a plate defining a series of apertures adapted to pick up corresponding openings in pole and hoop and bracket assembly mounts which may be mounted thereupon from either the play/- rebound surface side or the reverse side of the backboard.

9. The backboard according to claim 1 wherein integrally cast sections extend generally perpendicularly from the reverse side about the perimeter of said backboard.

10. The backboard according to claim 9 wherein said perimetrical sections are continuous except in the area of said hoop mounting means, the lower ends of said diagonal ribs conjoining with ends of said sections at each side of said hoop mounting means.

* * * * *